US006874973B1

(12) United States Patent
Yoshida

(10) Patent No.: US 6,874,973 B1
(45) Date of Patent: Apr. 5, 2005

(54) SELF-PROPELLED SOIL MODIFYING MACHINE

(75) Inventor: Yasuhiro Yoshida, Kawasaki (JP)

(73) Assignee: Komatsu Ltd., (JP)

( * ) Notice: Subject to any disclaimer, the term of this patent is extended or adjusted under 35 U.S.C. 154(b) by 477 days.

(21) Appl. No.: 09/979,187

(22) PCT Filed: Jun. 14, 2000

(86) PCT No.: PCT/JP00/03864

§371 (c)(1),
(2), (4) Date: Nov. 20, 2001

(87) PCT Pub. No.: WO00/77307

PCT Pub. Date: Dec. 21, 2000

(30) Foreign Application Priority Data

Jun. 15, 1999 (JP) ..... 11-168058

(51) Int. Cl.[7] ..... E02D 3/12; E02F 7/00
(52) U.S. Cl. ..... 404/91; 404/92; 37/142.5
(58) Field of Search ..... 404/90, 75, 91, 404/92, 76, 72, 81, 101, 104, 108, 111, 118; 241/101.74, 101.8; 37/142.5

(56) References Cited

U.S. PATENT DOCUMENTS

| | | | |
|---|---|---|---|
| 5,741,085 A | 4/1998 | Wirtgen | 404/75 |
| 5,988,937 A | 11/1999 | Komoriya et al. | 404/90 |

FOREIGN PATENT DOCUMENTS

| | | |
|---|---|---|
| EP | 915 205 | 5/1999 |
| EP | 974 702 | 1/2000 |
| JP | 7-80498 | 3/1995 |
| JP | 09195265 | 7/1997 |
| JP | 10-280471 | 10/1998 |

OTHER PUBLICATIONS

PCT International Preliminary Examination Report (Mar. 23, 2001).
European Search Report Oct. 10, 2002.

*Primary Examiner*—Christopher J. Novosad
(74) *Attorney, Agent, or Firm*—Rader, Fishman & Grauer, PLLC

(57) ABSTRACT

A machine body (1) having a traveling equipment (2) is provided with a mixer (3), a soil hopper (8), a raw soil conveying device (7) and a modified soil conveying device (10). Further, a soil conditioner supply device comprising a liquid supplying means (11), a liquid tank (12) and a liquid ejecting means (13) is provided for the machine body (1), and the liquid ejecting member (13) is attached to a portion close to an input port of the mixer (3), so that the liquid soil conditioner is ejected and supplied on the raw soil on the way of being conveyed by the raw soil conveying device (7). Since the soil conditioner is liquid, the liquid tank (12) and the liquid supplying means (11) can be formed to provide an arbitrary shape and can be mounted to an arbitrary portion with respect to the liquid ejecting means or an arbitrary portion apart from the liquid ejecting means. Accordingly, the liquid tank (12) can be mounted to a lower portion and can be formed to take an arbitrary shape suitable to a space for the tank by utilizing a flowability of the liquid, so that a capacity of the liquid tank can be increased. Therefore, at a time of supplying the liquid soil conditioner into the liquid tank (12), there is no need to use a crane required for supplying a powdery soil conditioner, so that the supplying work can be performed easily and a time interval of supplying the soil conditioner is made long and a frequency of supplying the soil conditioner can be reduced.

8 Claims, 14 Drawing Sheets

SELF-PROPELLED SOIL MODIFYING MACHINE

TECHNICAL FIELD

The present invention relates to a self-propelled soil modifying machine for modifying a soil quality by mixing a raw soil such as an excavated soil, a polluted soil or the like with a soil conditioner.

BACKGROUND ART

Japanese Patent Laid-open Publication No. HEI 9-195265 proposes a conventional self-propelled (self-propelled) soil modifying machine.

This self-propelled soil modifying machine generally comprises a machine body having a traveling equipment, a raw soil hopper into which a soil to be modified i.e., a raw soil, is thrown, a belt conveyer for conveying the raw soil stocked in the raw soil hopper, a soil conditioner supply device for supplying a soil conditioner to the raw soil on the way of being conveyed by the soil conveyer, a mixer for mixing the raw soil with the soil conditioner so as to modify a quality of the raw soil and a modified soil conveyer for conveying the modified soil to discharge it out of the machine body.

The soil conditioner supply device of the self-propelled soil modifying machine mentioned above comprises a soil conditioner hopper into which the soil conditioner is thrown, a shooter disposed to a discharge port of the hopper, and a rotor having a plurality of feeder plates for feeding the soil conditioner stocked in the hopper to the discharge port, the rotor being provided to a bottom portion in the hopper. When the solid (powdery) soil conditioner is thrown into the hopper and the rotor is driven so as to be rotated, the soil conditioner is supplied through the shooter and dropped down on the raw soil conveyer.

There may be used, as such soil conditioner, cement, cement-type solidifying agent, calcium lime, calcium hydroxide, lime-type solidifying agent, expandable beads and the like.

Because of the above reason, the conventional self-propelled soil modifying machine of the type mentioned above is not suitable for a self-propelled soil modifying machine utilized for a CSG construction method.

That is, in the CSG construction method, material prepared by mixing a soil at a construction site with cement is placed and spread over the construction site and then tamped for, for example, preparing or establishing a dam or the like, and in a case of less water containing ratio (water content) of a soil at the construction site, the water content is adjusted by adding water. However, such water content cannot be adjusted by the self-propelled soil modifying machine mentioned above, thus the conventional machine is not available.

In the above, although the explanation has been made with reference to the CSG construction method as one example, in another construction method, the self-propelled soil modifying machine of the conventional structure mentioned above is not proper for one for modifying soil by using liquid conditioner for solid conditioner as the soil conditioner.

DISCLOSURE OF THE INVENTION

An object of the present invention is to provide a self-propelled soil modifying machine capable of solving the problems mentioned above.

In order to achieve this and other objects, according to a first aspect of the present invention, there is provided a self-propelled soil modifying machine comprising:

- a machine body provided with a traveling equipment;
- a raw soil hopper mounted to the machine body, into which a raw soil to be modified is thrown;
- a raw soil conveying device mounted to the machine body for conveying the raw soil charged in the raw soil hopper;
- a solid soil conditioner supply device mounted to the machine body and adapted to supply a solid soil conditioner to the raw soil conveyed by the raw soil conveying device;
- a mixer mounted to the machine body for mixing the raw soil conveyed through the raw soil conveying device;
- a power source unit mounted to the machine body for supplying a power to the traveling equipment, the raw soil conveying device and the mixer; and
- a soil conditioner supply device for ejecting a liquid soil conditioner from a liquid ejecting means to which a liquid soil conditioner stocked in a liquid tank is supplied by a liquid supply means,
- wherein the liquid ejecting means is attached to at least one portion in a passage ranging from the raw soil hopper to a discharge portion of the mixer.

According to the first aspect of the present invention, the soil modifying machine comprises the solid soil conditioner supply device and the soil conditioner supply device in which a liquid soil conditioner stocked in a liquid tank is supplied by a liquid supply means, and the liquid soil conditioner is ejected from a liquid ejecting means, so that the soil modification can be performed by supplying both the solid soil conditioner and the liquid soil conditioner to the raw soil.

Accordingly, the raw soil and the cement can be mixed together while adjusting the water content of the raw soil by supplying the cement and water to the raw soil, so that the present invention is preferably applicable to a self-propelled soil modifying machine utilized for the CSG construction method.

Furthermore, since the flow rate of the liquid to be supplied per unit time by the liquid supply means can be precisely controlled by the pump revolution, drain amount and the like, the amount of water to be supplied in accordance with the water content of the raw soil can be precisely controlled and the water content of the modified soil can be easily adjusted to a predetermined value.

Furthermore, the liquid soil conditioner supply device has a structure in which the liquid soil conditioner in the liquid tank is supplied through the liquid supply means and then ejected from the liquid ejecting means, and the soil conditioner is in a liquid state, so that the liquid tank and the liquid supply means can be formed in an arbitrary form and mounted to arbitrary or apart portions with respect to the liquid ejecting means.

Therefore, the liquid tank can be mounted to a lower portion, and since the tank can be formed to provide an arbitrary shape by utilizing a flowability (fluidity) of the liquid in conformity with an available space in which the tank is mounted, the liquid tank can be formed to secure a large capacity, and the work for supplying the conditioner can be easily performed and a time interval of the supplying work becomes long to thereby reduce a frequency of the supplying work.

In cooperation with these advantages, the work of supplying the liquid soil conditioner can be easily performed in a short time, thus improving the efficiency of the supplying work.

Furthermore, the liquid tank can be mounted to an arbitrary portion in an arbitrary form, so that a space for the liquid tank is efficiently available and a plurality of liquid tanks can be easily mounted. In such case, since a plural kinds of soil conditioners can be supplied, the liquid soil conditioners suitable for the raw soil can be supplied individually or in a combined state, and hence, the modifying effect can be further improved. In addition, the self-propelled soil modifying machine can be formed in a compact size.

In the first aspect of the present invention, it is preferable that the liquid ejecting means is mounted to at least one portion among a portion in the raw soil hopper, a portion close to a charge port of the mixer of the raw soil conveying device, a portion in the mixer, and a discharge port of the mixer.

According to this structure, the liquid soil conditioner can be supplied to at least one soil selected from the raw soil stocked in the raw soil hopper, a raw soil to be conveyed, the soil in the mixer and the soil discharged from the mixer.

For example, when the liquid soil conditioner is supplied to the raw soil stocked in the raw soil hopper, the liquid soil conditioner is also infiltrated into the soil on the way of being conveyed, and hence, a degree of the infiltration is enhanced to thereby improve a mixing performance of the soil at the mixer.

When the liquid soil conditioner is supplied to the raw soil to be conveyed at a portion above the raw soil conveying device close to an input port of the mixer, there can be reduced a portion of the machine to which a suitable measure should be taken to prevent a leakage of the liquid soil conditioner. In addition, the liquid soil conditioner quickly infiltrates into the raw soil to thereby provide a good infiltrating performance, so that the liquid soil conditioner can be sufficiently mixed by the mixer.

Furthermore, the amount of the liquid soil conditioner to be supplied in accordance with an amount of the raw soil to be conveyed can be accurately controlled through a control of pumping operation, so that the mixing ratio of the conditioner to the raw soil is always made suitable, and the control thereof is made simplified.

When the liquid soil conditioner is supplied inside the mixer, the interior of the mixer takes an atmosphere of the liquid soil conditioner, the raw soil and the conditioner can be sufficiently mixed, and there is less fear of the liquid soil conditioner leaking outside.

In the above first aspect of the present invention, it is preferable that a rear mixer for mixing a soil discharged from the mixer is further provided.

According to this arrangement, the soil discharged from the mixer is further mixed by the rear mixer, so that a mixing degree can be further improved and the modifying reaction is also promoted quickly.

In the above first aspect of the present invention, it is preferable that the liquid ejecting means is attached to the discharge port of the mixer, and the rear mixer for mixing the ejected liquid soil conditioner with the discharged soil is mounted to a portion lower than the liquid ejecting means.

According to this arrangement, the soil discharged from the mixer and the liquid soil conditioner are further mixed by means of the rear mixer, providing further improved mixing performance, and the reaction of modifying the quality of the soil is promoted more quickly.

In a second aspect of the present invention, there is provided a self-propelled soil modifying machine comprising:

a machine body provided with a traveling equipment;

a raw soil hopper mounted to the machine body into which a raw soil to be modified is thrown;

a raw soil conveying device mounted to the machine body for conveying the raw soil charged in the raw soil hopper;

a solid soil conditioner supply device mounted to the machine body and adapted to supply a solid soil conditioner to the raw soil conveyed through the raw soil conveying device;

a mixer mounted to the machine body for mixing the raw soil conveyed by the raw soil conveying device;

a modified soil conveying device mounted to the machine body for discharging the soil mixed by the mixer;

a power source unit mounted to the machine body for supplying a power to the traveling equipment, the raw soil conveying device, the mixer and the modified soil conveying device; and a soil conditioner supply device for ejecting a liquid soil conditioner from a liquid ejecting means to which the liquid soil conditioner stocked in a liquid tank is supplied by a liquid supply means, wherein the liquid ejecting means is attached to at least one portion in a passage ranging from the raw soil hopper to the modified soil conveying device.

According to the second aspect of the present invention, in addition to the same advantageous effects as those provided in the first aspect of the present invention, the modified soil having improved quality can be conveyed to the outside of the machine body by the modified soil conveying device, and since the modified soil conveying device travels and moves together with the machine body, there can be provided a self-propelled soil modifying machine excellent in mobility.

In this second aspect of the present invention, it is preferable that the liquid ejecting means is attached to at least one portion among a portion in the raw soil hopper, a portion above the raw soil conveyer close to a input port of the mixer, a portion in the mixer, and a discharge port of the modified soil conveying device.

According to this arrangement, the liquid soil conditioner can be supplied to at least one soil selected from the soil stocked in the raw soil hopper, the raw soil to be conveyed, the soil in the mixer and the soil to be discharged from the mixer.

In the above second aspect of the present invention, it is preferable that the self-propelled soil modifying machine further comprises a rear mixer for mixing a soil discharged from the modified soil conveying device.

According to this arrangement, the soil discharged from the modified soil conveying device is further mixed by the rear mixer, so that a mixing performance can be further improved and the reaction is also promoted quickly.

In the above second aspect of the present invention, it is preferable that the liquid ejecting means is attached to the discharge port of the modified soil conveying device, and the rear mixer for mixing the ejected liquid soil conditioner with the discharged soil is mounted to a portion lower than the liquid ejecting means.

According to the above arrangement, the soil discharged from the modified soil conveying device and the liquid soil conditioner are further mixed by the rear mixer, so that a mixing performance can be further improved and the reaction of modifying the quality of the soil is promoted more quickly.

In the first and second aspects of the present invention mentioned above, it is preferable that the liquid supply means and the liquid tank are mounted to the machine body.

According to this arrangement, since the liquid supply means and the liquid tank travel and move together with the machine body, a mobility of the self-propelled soil modifying machine is excellent.

In the first and second aspects of the present invention mentioned above, it is preferable that at least one or both the liquid supply means and the liquid tank are disposed independently from the machine body.

According to such arrangement, it is not required for the machine body to provide a space for mounting either the liquid supply means or the liquid tank or both the liquid supply means and the liquid tank to be independently provided from the machine body, so that the self-propelled soil modifying machine can be formed to provide a compact size.

In the first and second aspects of the present invention, it is preferable that the liquid supply means comprises a fluid pump driven by the power source for the pump, and a delivery (discharge) side of the fluid pump is connected to the liquid ejecting means through a delivery pipe.

According to this arrangement, the amount of the liquid soil conditioner to be supplied per unit time is easily and accurately controlled through the adjustment of the power source unit for the pump to thereby increase or decrease the rotation speed of the fluid pump. Therefore, the supply amount of the liquid soil conditioner can be easily and accurately controlled to be an arbitrary amount.

In addition, since the delivery side of the fluid pump is connected to the liquid ejecting means through the delivery pipe, even if the fluid pump is located to be apart from the liquid ejecting means, the fluid pump is connected to the liquid ejecting means by providing the delivery pipe, so that the liquid ejecting means can be mounted in a narrow space.

Furthermore, since it is also possible to independently provide the fluid pump and the liquid tank to be apart from the machine body, the liquid tank can be formed to have a large capacity, so that the soil-quality modifying work can be continuously performed without resupplying the soil conditioner to the liquid tank for a long time.

In any one of the arrangements described hereinbefore, the liquid ejecting means may preferably be constituted by any one of members such as a pipe structure, a pipe having a long scale to which a plurality of ejecting holes are provided, a pipe having a funnel-shape at a front end portion thereof and a plurality of ejecting holes are formed to a front end surface of the pipe, and a pipe having a large-diametered front end portion and a plurality of ejecting holes having a small diameter are formed to a front end surface of the pipe.

According to the above arrangement, the liquid ejecting means constituted by the pipe structure simplifies a shape of the means, resulting in a low cost.

When the liquid ejecting means is constituted by the pipe having a long scale to which a plurality of ejecting holes are provided, the liquid soil conditioner can be uniformly supplied to a broad area of the soil.

When the liquid ejecting means is constituted by the pipe having a funnel-shape at the front end portion thereof and a plurality of ejecting holes are formed to the front end surface of the pipe, or when it is constituted by the pipe having a large-diametered front end portion and a plurality of ejecting holes each having a small diameter are formed to the front end surface of the pipe, the liquid soil conditioner can be uniformly ejected in a mist form over a broad area of the soil. Therefore, this type of the liquid ejecting means is suitable for a case where the liquid soil conditioner is ejected to the soil in the mixer or the soil discharged from the modified soil conveying device.

BRIEF DESCRIPTION OF THE DRAWINGS

The present invention will become more apparent upon a consideration of the following detailed explanations of the preferred embodiments of the present invention taken in conjunction with the accompanying drawings. It is to be understood that the embodiments shown in the accompanying drawings are not for particularly specifying the present invention but for merely making the explanations and understanding of the present invention more easily.

In the accompanying drawings.

BEST MODE FOR EMBODYING THE INVENTION

Preferred embodiments of the present invention will be described hereunder with reference to the accompanying drawings.

Figure 1:
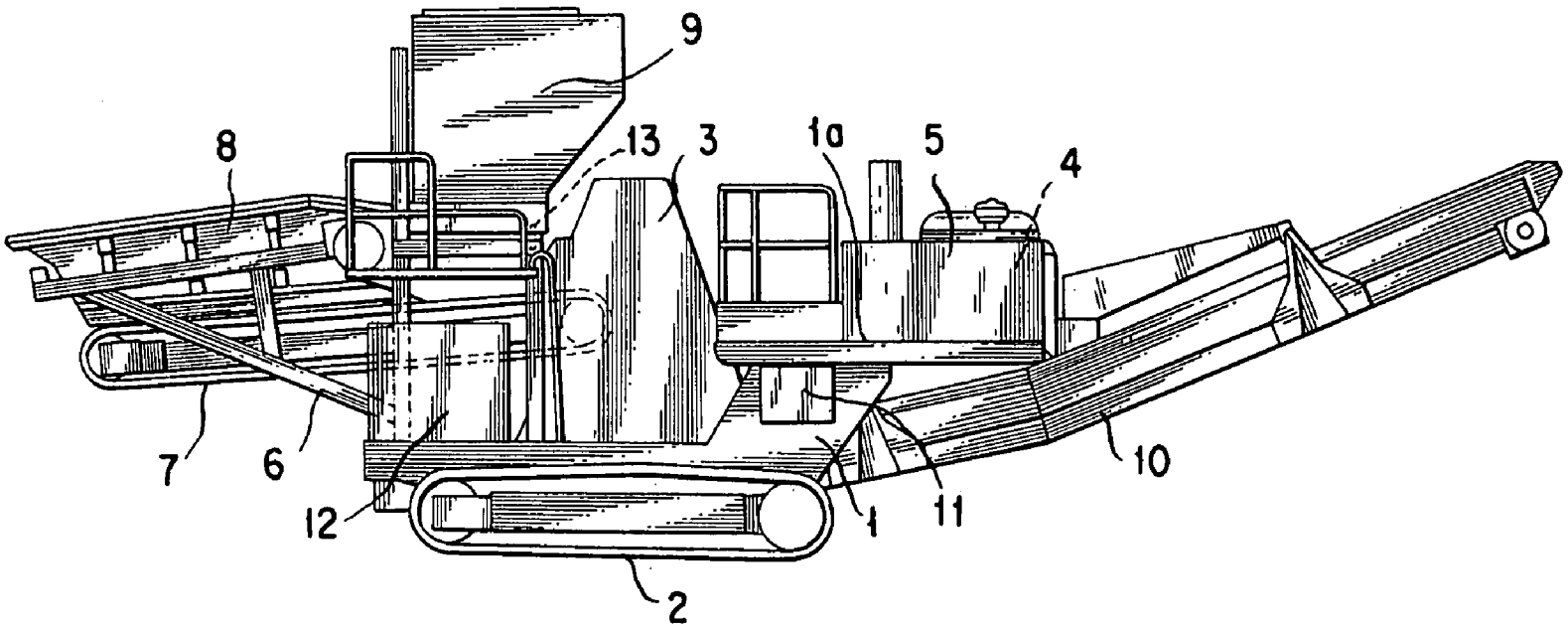
FIG. 1 is a side view showing one embodiment of a self-propelled soil modifying machine according to the present invention.
Figure 2:
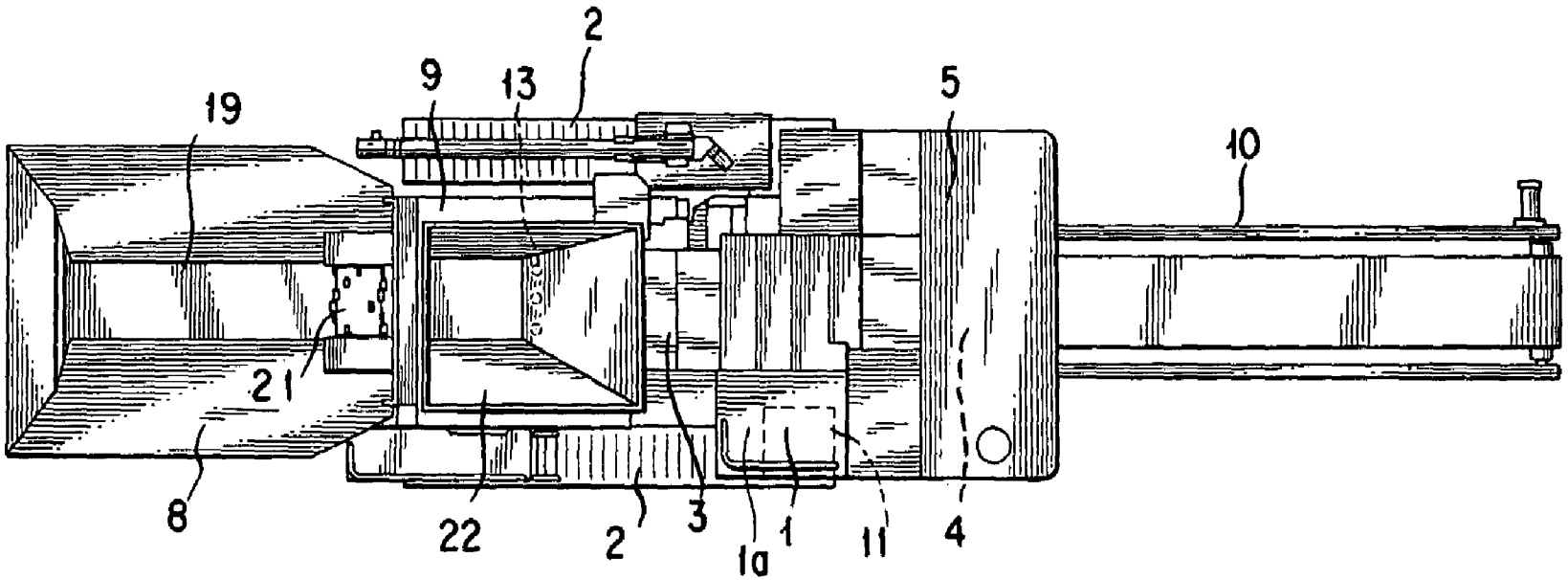
FIG. 2 is a plan view of this embodiment.
Figure 3:
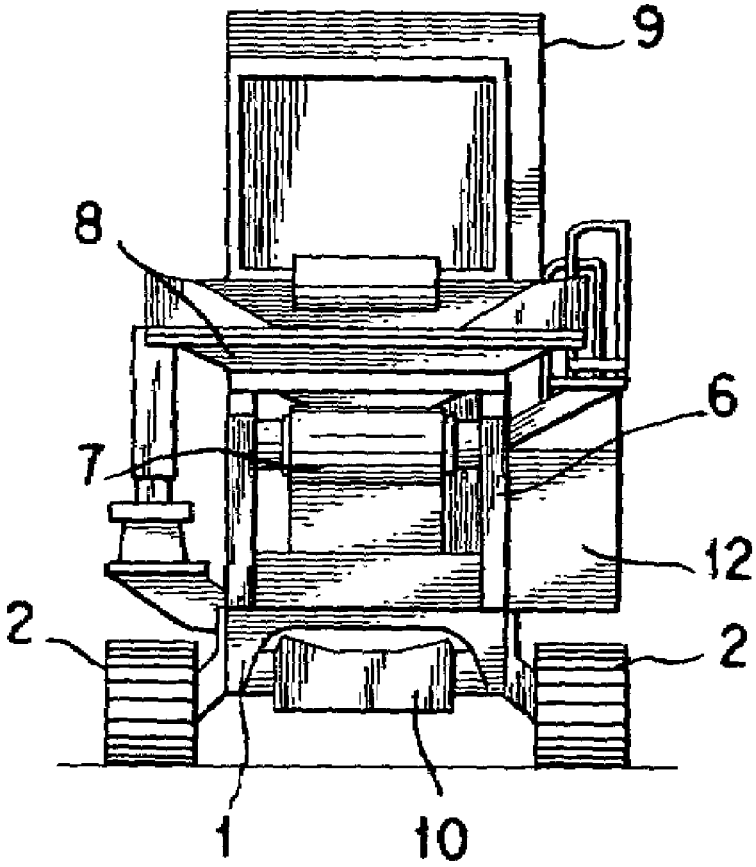
FIG. 3 is a front view of the embodiment.

As shown in FIGS. 1, 2 and 3, right and left traveling equipments 2, 2 are attached to a machine body 1 so as to form a self-propelled vehicle. A mixer 3 is provided to an intermediate portion between front and rear portions of the machine body 1. At a front portion side of the machine body 1 is provided a power source unit 4 including an engine, a hydraulic pump, a generator, or a combination thereof. The power source unit 4 is covered with a cover 5. The traveling equipment 2 is formed as a crawler-type structure, but may also be formed as a wheel-type structure. Further, the machine body 1 is provided with a boarding platform 1*a*.

At a rear side of the machine body 1 is provided a mount frame 6 so as to project rearward from the machine body 1, and a raw soil conveying device 7 is mounted to the mount frame 6 so as to extend in the longitudinal direction thereof. Furthermore, a raw soil hopper 8 is mounted to the mount frame 6 so that the hopper 8 is positioned above a rear side of the raw soil conveying device 7. A solid soil conditioner supply device 9 is mounted to a portion between the raw soil hopper 8 and the mixer 3 so that the solid soil conditioner supply device 9 covers a portion above a front side portion of the raw soil conveying device 7.

At a lower portion of the machine body 1 is provided a modified soil conveying device 10 so as to extend in the longitudinal direction thereof. One end portion (rear side portion) of the modified soil conveying device 10 in the conveying directio is positioned below the mixer 3, while another end portion (front side portion) of the modified soil conveying device 10 extends forward over the machine body 1.

The power source unit 4 has a function of supplying a power to the traveling equipment 2, the raw soil conveying device 7, the mixer 3 and the modified soil conveying device 10.

A liquid supply means 11 is provided to either right or left side portion on the front side portion of the machine body 1, while a liquid tank 12 is provided to either right or left side portion on the rear side portion of the machine body 1. At a portion above the raw soil conveying device 7 close to the input port of the mixer 3, a liquid ejecting means 13 is attached so as to oppose to the raw soil conveying device 7. These liquid ejecting means 13, liquid supply means 11 and liquid tank 12 constitute a soil conditioner supply device.

Figure 4:
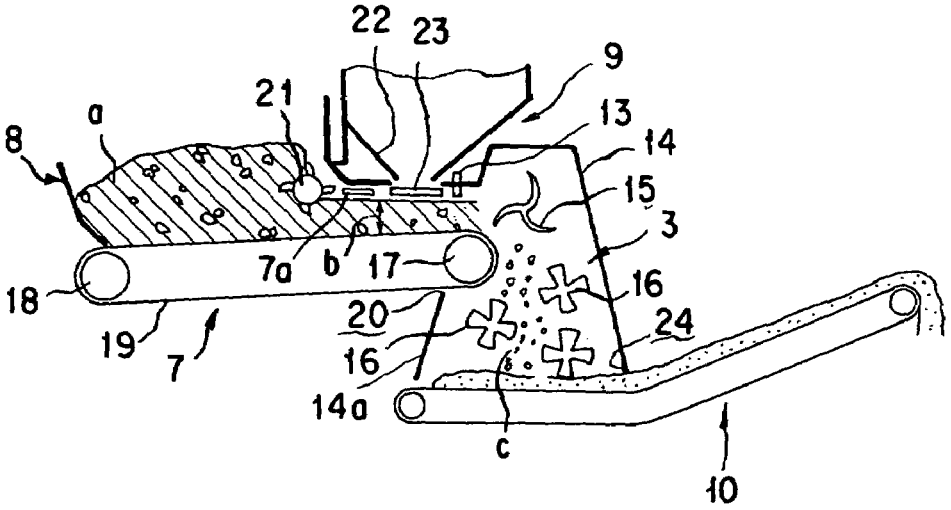
FIG. 4 is an explanatory view explaining an operation of the embodiment.

As shown in FIG. 4, the mixer 3 is provided with a soil cutter device 15 as a primary mixing unit and a plurality of impact hammers (rotor provided with rotators) 16 as a secondary mixing unit mounted in a case 14.

The aforementioned raw soil conveying device 7 is constituted as a conveyer which is composed of a driving wheel 17, a driven wheel 18 and an endless belt-like member 19 wrapped therearound. This raw soil conveying device 7 has a discharge side end portion which extends into the case 14 of the mixer 3 through an entrance (input) port 20 formed to a side wall section 14*a* of the case 14 of the mixer 3. The endless belt-like member 19 is a crawler belt composed of a plurality of iron crawler plates that are connected in an endless shape. However, a belt may be also used as the endless belt-like member 19.

A raking (raking-type) rotor 21 is mounted on the discharge side of the raw soil hopper 8, the raking rotor having a function of making constant a cut-off height b of the raw soil a. This height b means a height of the raw soil a conveyed by the raw soil conveying device 7 towards the mixer 3.

A raw soil sensor 17*a* for detecting a height of the soil is disposed above the raw soil conveying device 7, and this sensor 17*a* is switched over to "ON" state upon the detection of the conveyance of the raw soil on the conveying device 7 at a time when the height of the raw soil on the conveying device 7 becomes over a predetermined height, for example, about 70% of the height b.

The solid soil conditioner supply device 9 mentioned above has a structure in which a constant amount supply mechanism 23 is attached at the discharge port of the hopper 22, and the liquid ejecting means 13 is mounted to the side of the mixer 3 rather than the constant amount supply mechanism 23.

One side portion in the conveying direction of the modified soil conveying device 10 is positioned below a discharge port 24 of the case 14 of the mixer 3.

Figure 5:
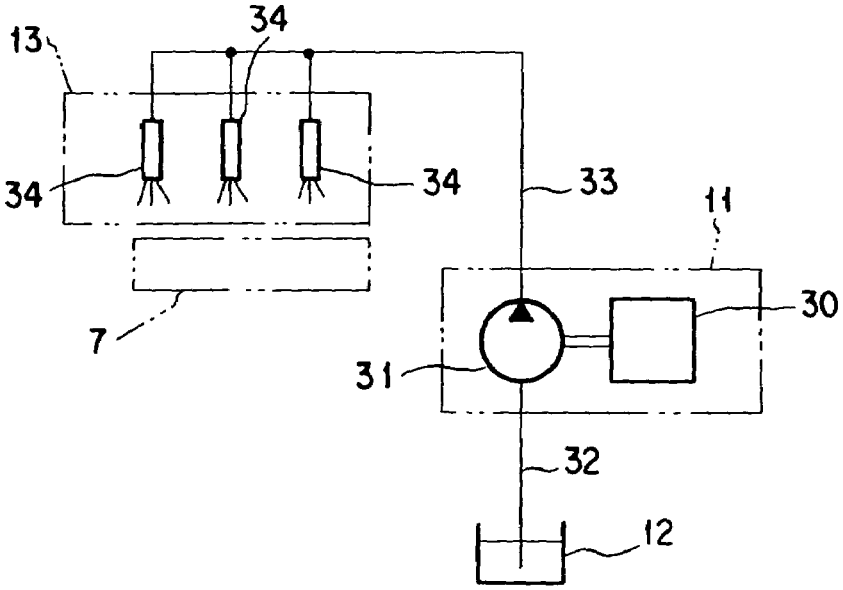
FIG. 5 is an explanatory view explaining a liquid soil conditioner supply device of the embodiment.

The aforementioned liquid supply means 11 is, as shown in FIG. 5, a fluid pump 31 driven by a power source 30 for the pump such as an internal combusion engine, an electric motor or the like. A suction port of the fluid pump 31 is connected to the liquid tank 12 through a suction line 32 such as a pipe, hose or the like, so that the fluid pump 31 sucks the liquid soil conditioner stocked in the liquid tank 12, and then, the sucked conditioner is delivered or discharged to a delivery line 33 such as a pipe, hose or the like. In this connection, it is also possible to use the engine of the power source unit 4 as the power souce 30 for the pump.

The aforementioned liquid ejecting means 13 comprises a plurality of pipes 34, each of which is connected to the delivery pipe 33. Further, the pipes 34 may be also formed from a single pipe member.

As shown in FIG. 4, the raw soil a such as the excavated soil or the like thrown in the raw soil hopper 8 is conveyed towards the mixer 3 in a state having a predetermined cut-out height by means of the raw soil conveying device 7 and the racking rotor 21. When the raw soil is conveyed to the mixer 3, the raw soil sensor 7*a* is made "ON" and the constant amount supply mechanism 23 is driven, so that the solid soil conditioner in the hopper 22 drops to be supplied, and thereafter, the power source 30 for the pump is driven to spray the liquid soil conditioner on the raw soil a through the liquid ejecting means 13 (pipe 34). This liquid soil conditioner quickly infiltrates into the raw soil, thus providing a good infiltrating property.

The raw soil a and the solid soil conditioner conveyed into the case 14 of the mixer 3 are cut off by the soil cutter device 15 and then subjected to crushing, mixing and stirring treatments through the impact hammers 16, whereby the nature and quality of the raw soil a are modified to be a modified soil c. The modified soil c of which nature and condition are improved is then fallen and supplied onto the modified soil conveying device 10 through the discharge port 24 formed to the case 14 of the mixer 3, and thereafter, conveyed by the modified soil conveying device 10 forward the machine body.

As described hereinbefore, the raw soil a is cut off by the soil cutter device 15 so as to provide a flake-shape having a predetermined thickness, and the solid soil conditioner and the liquid soil conditioner adhere to a portion of the cut-off soil. The raw soils a each having the flake-shape in a state that the portions, to which the solid and liquid soil conditioners adhere, take various positions such as upper position, lower position, lateral position or the like, and then, crushed and mixed by the impact hammers 16 so as to mix the solid soil conditioner sufficiently with the liquid soil conditioner.

As mentioned above, by using cement as such solid soil conditioner and using water as such liquid soil conditioner and by adjusting (increasing or decreasing) the water supply amount in accordance with the water content of the raw soil to thereby prepare a predetermined water content ratio, the hydration of the cement progresses and the raw soil and the cement can be adequately mixed, thus providing mixture soil having desired strength.

Figure 6A:
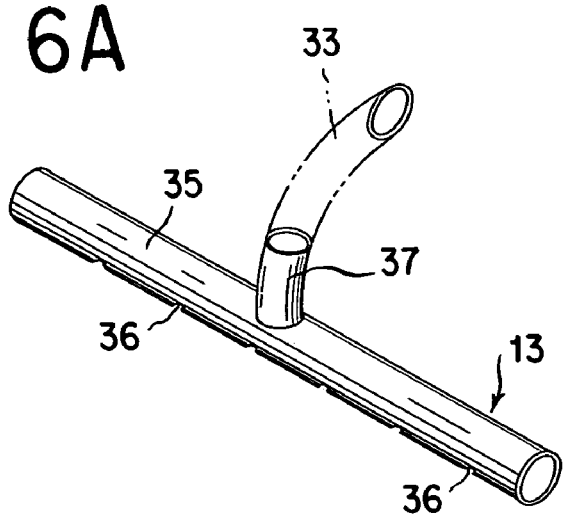
FIGS. 6A to 6C are perspective views each showing a liquid ejecting means for the liquid soil conditioner supply device.

As shown in FIG. 6A, the liquid ejecting means 13 can be formed to provide a structure in which a plurality of ejecting holes 36 are formed to a plurality of portions along the longitudinal direction of a long pipe 35, and a connecting portion 37 for connecting the delivery pipe 33 is formed to this long pipe 35.

Figure 6B:
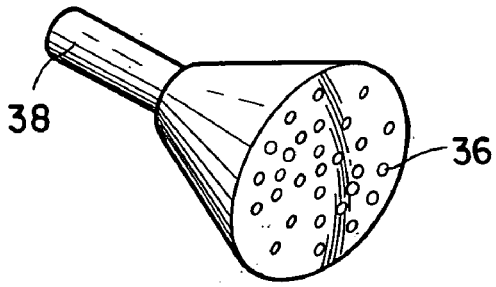

Further, as shown in FIG. 6B, the liquid ejecting means 13 may be also formed to provide a structure in which the liquid ejecting means 13 comprises a pipe 38 having a funnel-shape at a front end portion thereof, and a plurality of ejecting holes 36 are formed to a front end surface of the pipe 38.

Figure 6C:
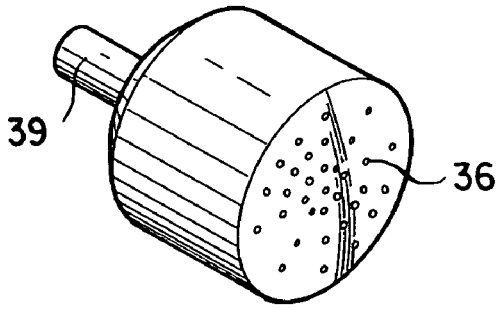

Furthermore, as shown in FIG. 6C, the liquid ejecting means 13 may be also formed to provide a structure in which the liquid ejecting means 13 comprises a pipe 39 having a large-diametered front end portion, and a plurality of ejecting holes 36 having a small diameter are formed to a front end surface of the pipe 39 to eject an atomized liquid solid conditioner.

The liquid supply means 11 and the liquid tank 12 can be formed to provide arbitrary forms and can be mounted to arbitrary portions of the machine body 1. That is, since the soil conditioner is liquid, the flowability thereof can be utilized, so that the liquid supply means 11 and the liquid tank 12 can be formed to provide arbitrary forms so as to match with the arbitrary portions i.e., space, and can be mounted to the arbitrary portions.

Figure 7A:
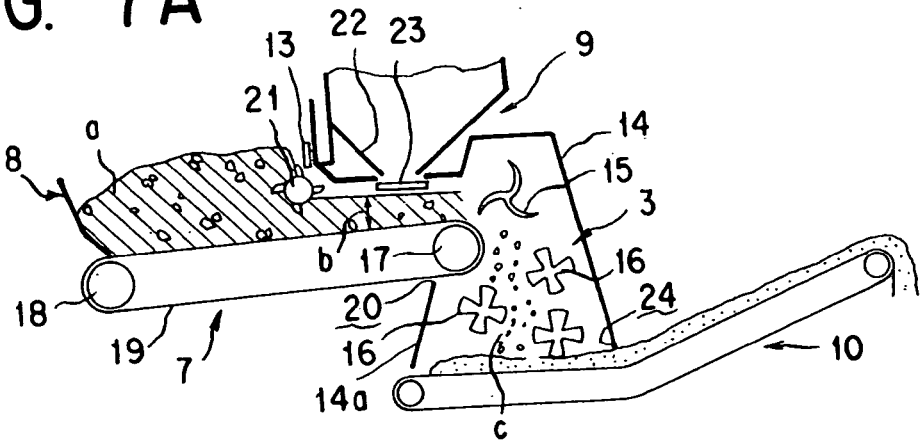
FIGS. 7A to 7C are explanatory views each explaining a mounting position of the liquid ejecting means.

The liquid ejecting means 13 may be attached, as shown in FIG. 7A, to a portion closer to the mixer 3 than the rotor 21 provided in the raw soil hopper 8.

Figure 7B:
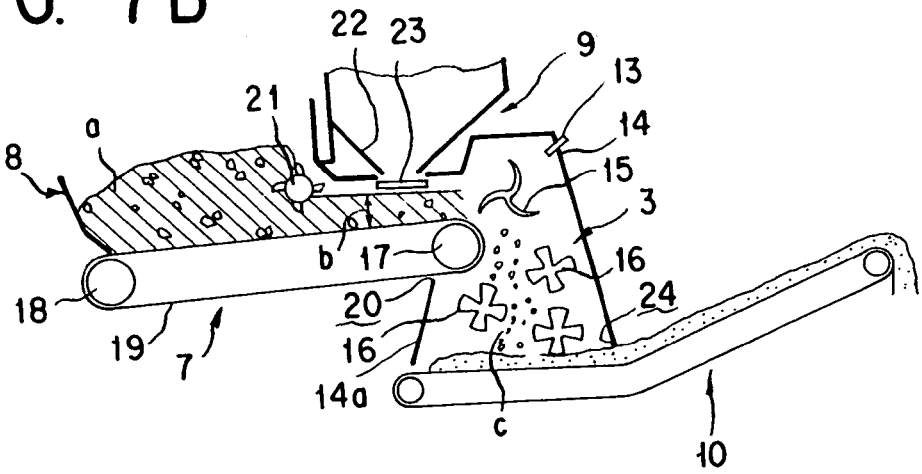

Further, as shown in FIG. 7B, the liquid ejecting means 13 may be attached so as to be directed downward to a portion near an upper portion inside the case 14 of the mixer 3, and in such arrangement, the liquid ejecting means 13 shown in FIGS. 6B and 6C may be preferably utilized.

Figure 7C:
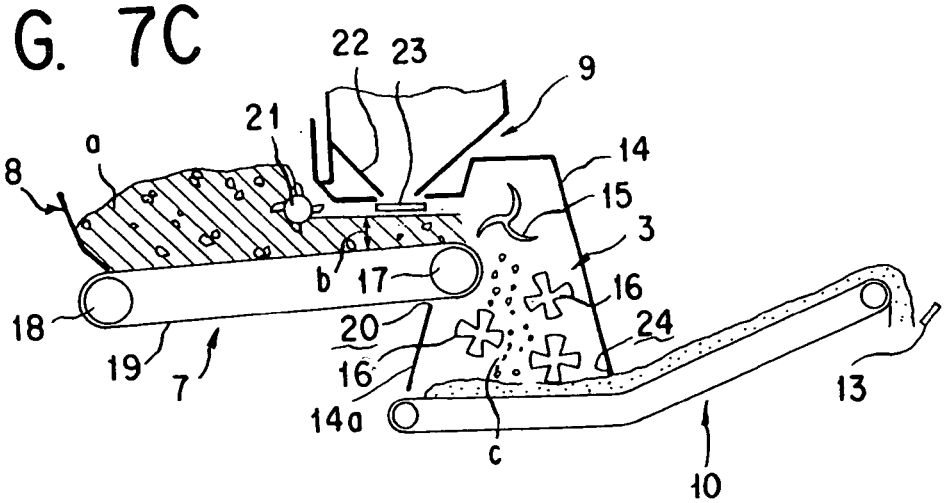

Furthermore, as shown in FIG. 7C, the liquid ejecting means 13 may be attached at a portion close to the discharge port of the modified soil conveying device 10 so as to oppose to the soil dropping down from the modified soil conveying device 10, and in such arrangement, the liquid ejecting means 13 shown in FIGS. 6B and 6C may be preferably utilized.

A concrete structure of the example shown in FIG. 7C will be mentioned hereunder.

Figure 8:
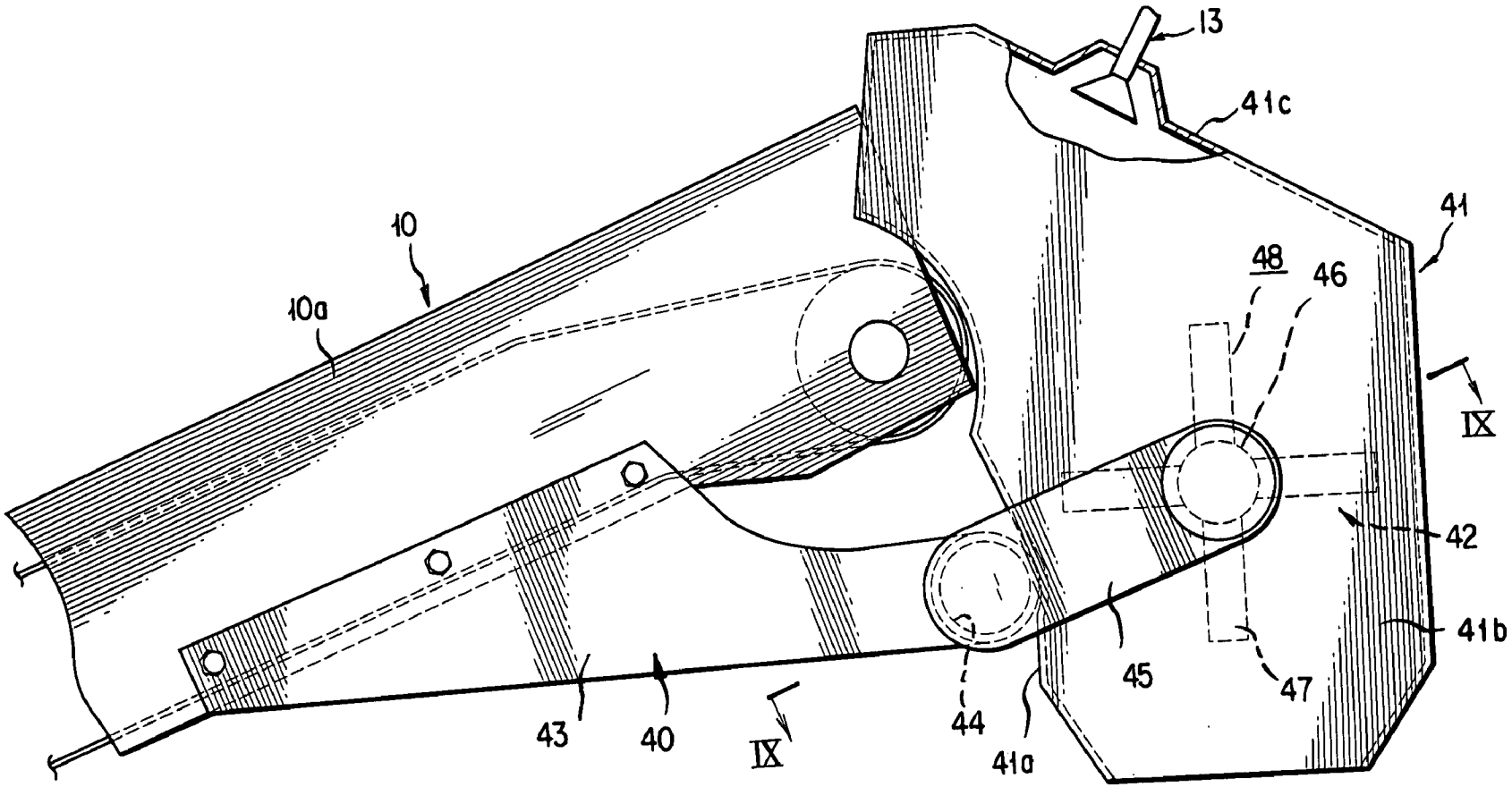
FIG. 8 is a side view showing a mounting portion of a rear mixer for the embodiment.
Figure 9:
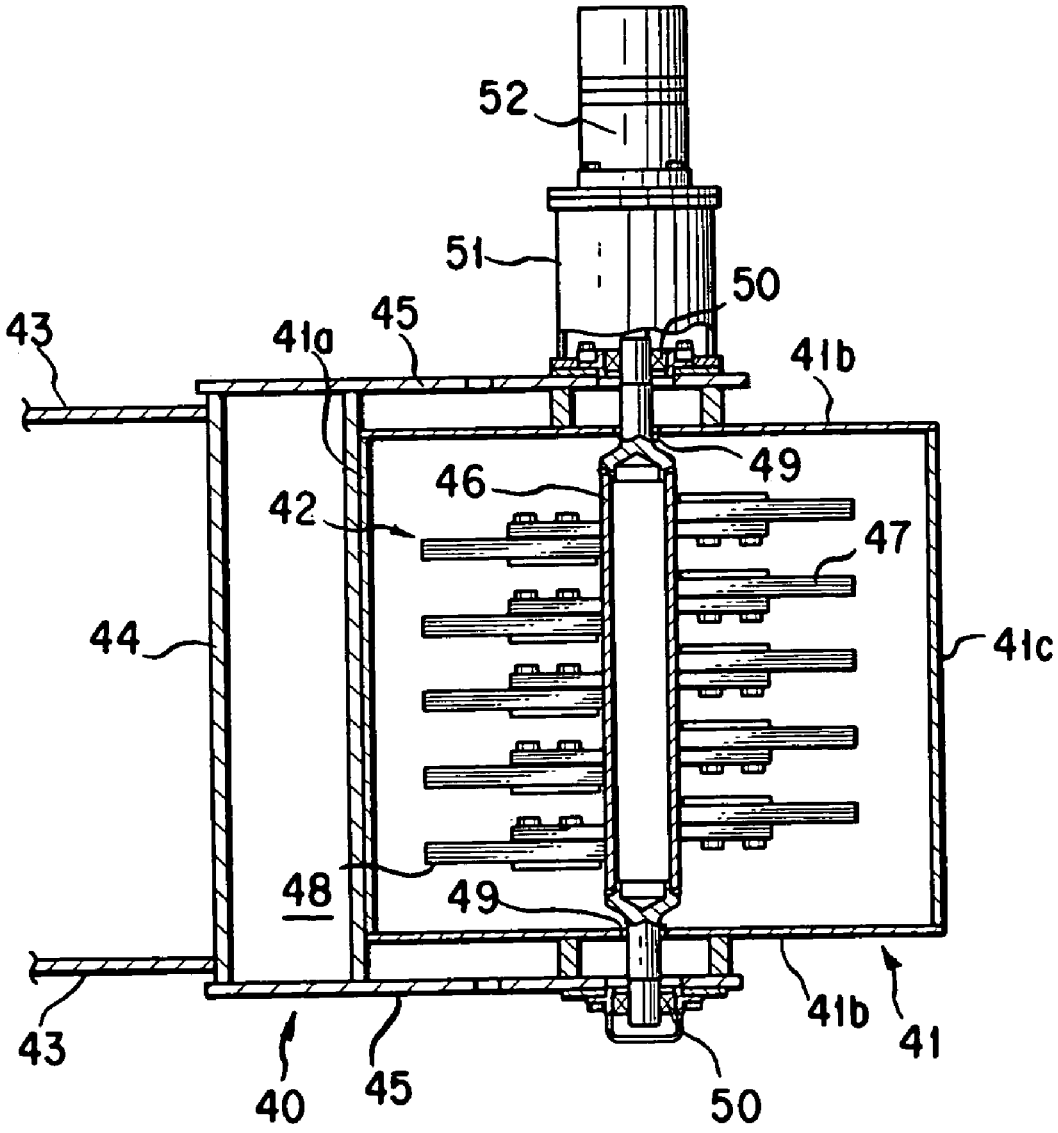
FIG. 9 is a cross sectional view taken along the line IX—IX in FIG. 8.

For example, as shown in FIGS. 8 and 9, a mount member 40 is fixed to a discharge end portion of a frame body 10*a* of the modified soil conveying device 10, and a cover member 41 is fixed to the mount member 40, and then, the liquid ejecting means 13 is attached to an upper portion of the cover member 41 so as to oppose the falling soil.

Further, a rear mixer 42 is attached to a lower portion of the cover member 41. The mount member 40 has an H-shape in a plan view and is formed in such a manner that a pair of mount plates 43 are connected through a connecting member 44, and then, a pair of plates 45 are fixed to the connecting member 44 and the paired mount plates 43 are fixed to both right and left side portions of the frame body 10*a* by means of bolts or the like.

The cover member 41 has an approximately rectangular-box-shape in which a rear side wall 41*a* is fixed to the connecting member 44 by means of bolts or the like, while right and left side walls 41*b* being positioned inside the paired plates 45, and the liquid ejecting means 13 is attached to an upper portion of a front side wall 41*c* of the cover member 41.

The rear mixer 42 mentioned before comprises a rotor 48 formed in such a manner that a plurality of mixing blades 47 are arranged around a rotational shaft 46 so as to extend radially from the shaft to form a mixing unit, and then, a plural set of the mixing units are attached to the rotational shaft 46 with intervals in an axial direction of the rotational shaft 46. The rotational shaft 46 passes through holes 49 formed to lateral side walls 41*b* of the cover member 41 and is supported to be rotatable by the paired right and left plates 45 through bearings 50.

A hydraulic motor or an electric motor 52 is mounted to one of the paired plates 45 through a cylinder body 51, an output (drive) shaft of the motor 52 is connected to the rotational shaft 46 in the cylinder body 51 through a coupling member (not shown), so that the motor 52 is driven so as to rotate the rotor 48.

Figure 10:
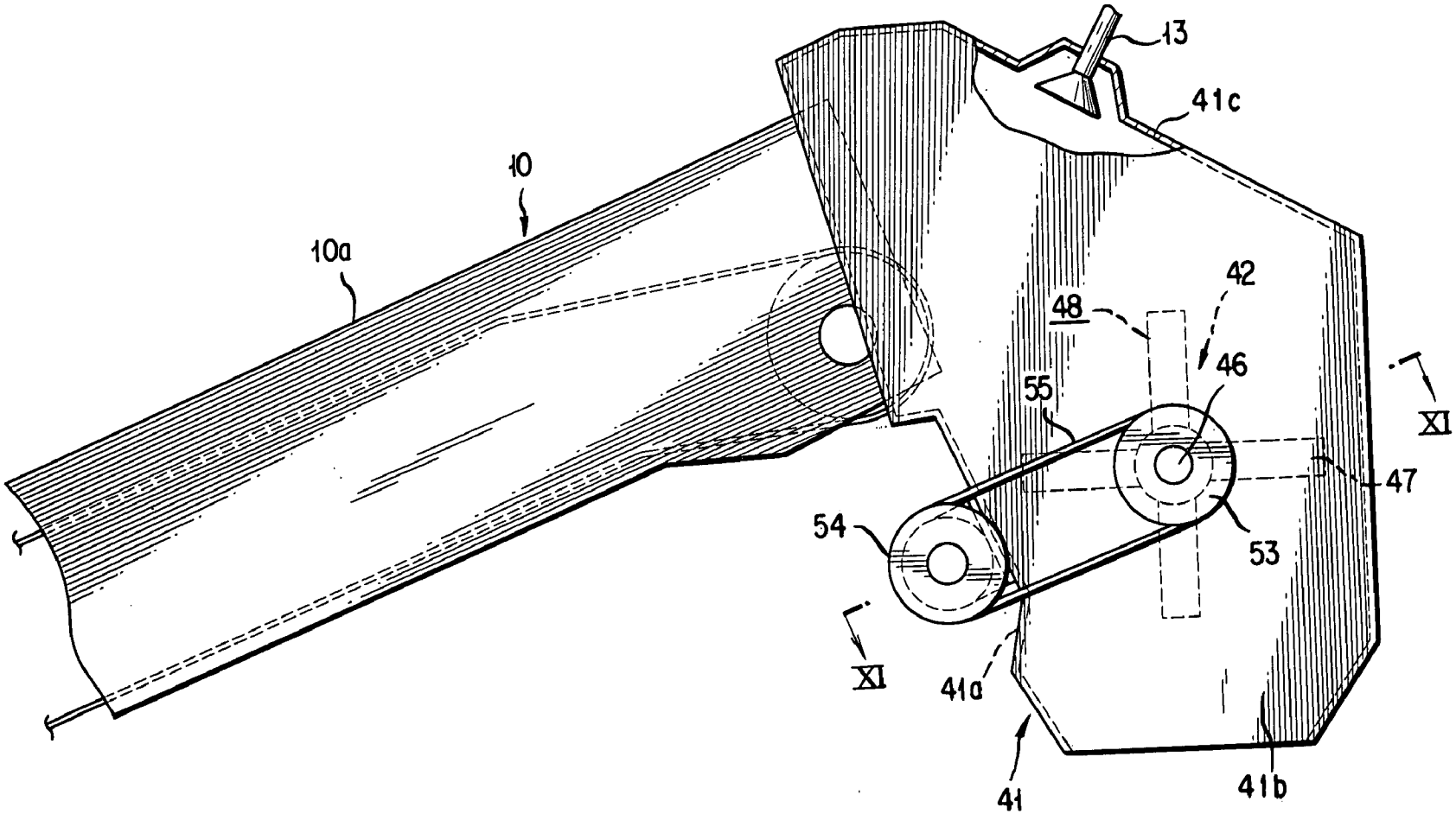
FIG. 10 is a side view showing another mounting portion of the rear mixer.
Figure 11:
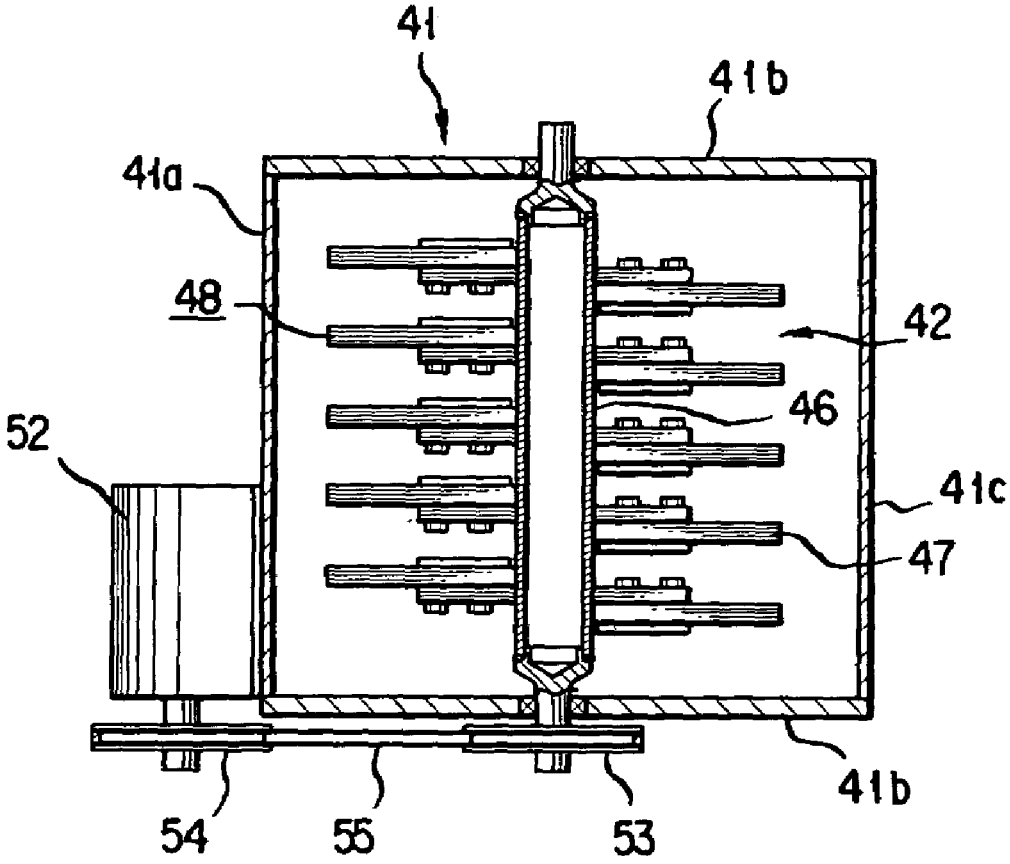
FIG. 11 is a cross sectional view taken along the line XI—XI in FIG. 10.

Still furthermore, the rear mixer 42 may be also formed so as to provide a concrete structure shown in FIGS. 10 and 11. That is, a cover member 41 having a rectangular section and cylindrical shape is fixed to a discharge end portion of the frame body 10*a* of the modified soil conveying device 10 so as to direct downward, and the liquid ejecting means 13 is attached to an upper portion of the cover member 41 so as to oppose to the falling soil.

The rotational shaft 46 of the rear mixer 42 is supported to be rotatable at lower portions of the lateral side walls 41*b* of the cover member 41, and the hydraulic motor or the electric motor 52 is mounted to a rear side wall 41*a* of the cover member 41.

A belt 55 is wrapped around a portion between a pulley 53 fixed to the rotational shaft 46 and a pulley 54 to be rotated by the motor 52, whereby when the motor 52 is driven, the rotor 48 is rotated.

According to the arrangement mentioned above, the liquid soil conditioner is ejected to the soil falling from the modified soil conveying device 10 to be mixed together. Thereafter, the soil and the liquid soil conditioner are sufficiently mixed again by the rear mixer 42.

The location of the liquid ejecting means 13 is not limited to only one portion and the liquid ejecting means 13 may be attached respectively to four portions as shown in FIGS. 4, 7A, 7B, and 7C.

Further, the liquid ejecting means 13 may be also attached respectively to optional two portions in the vicinity of the four portions shown in FIGS. 4, 7A, 7B, and 7C.

Further, the liquid ejecting means 13 may be also attached respectively to optional three portions in the vicinity of the four portions shown in FIGS. 4, 7A, 7B, and 7C.

Figure 12A:
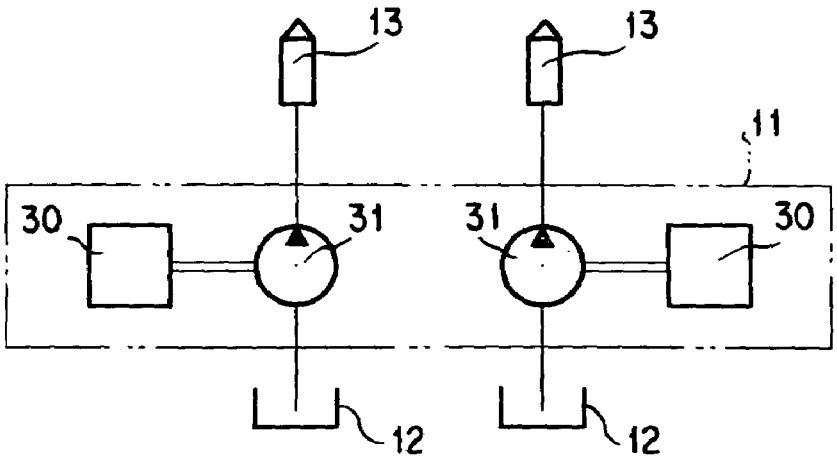
FIGS. 12A and 12B are explanatory views each showing an embodiment in which a plurality of liquid ejecting means are used.

In a case, as mentioned above, where the liquid ejecting means 13 is attached respectively to a plurality of portions, a set of the fluid pump 31, the liquid tank 12 and the power source 30 for the pump may be independently arranged to the liquid ejecting means 13, respectively, as shown in FIG. 12A.

According to such arrangement, when the liquid soil conditioners of the kinds different from each other are packed in the liquid tanks 12 respectively, the liquid soil conditioners of the different kinds can be ejected supplied at different portions.

Figure 12B:
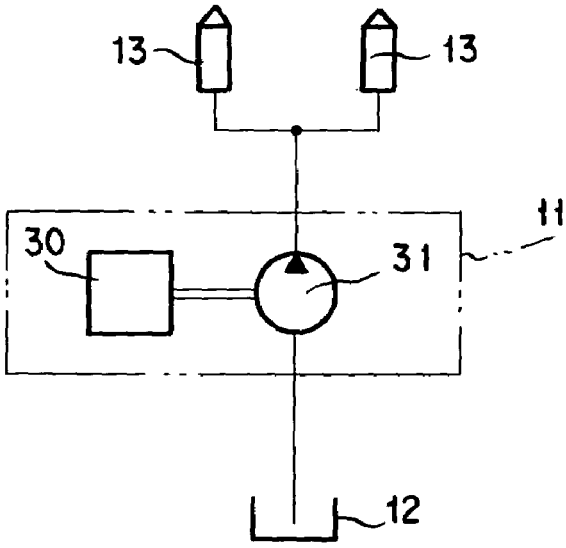

Further, as shown in FIG. 12B, there may be also adopted an arrangement in which one fluid pump 31, one liquid tank 12 and one power source 30 for the pump are provided so as to feed one kind of (same) liquid soil conditioner, under pressure, to a plurality of the liquid ejecting means 13.

Figure 13A:
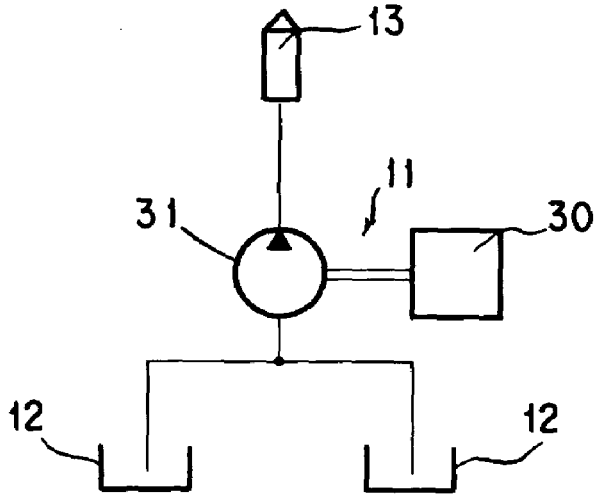
FIGS. 13A and 13B are explanatory views each showing an example in which a plurality of different kinds of liquid soil conditioners are mixed and then the mixed liquid is ejected from one liquid ejecting means.
Figure 13B:
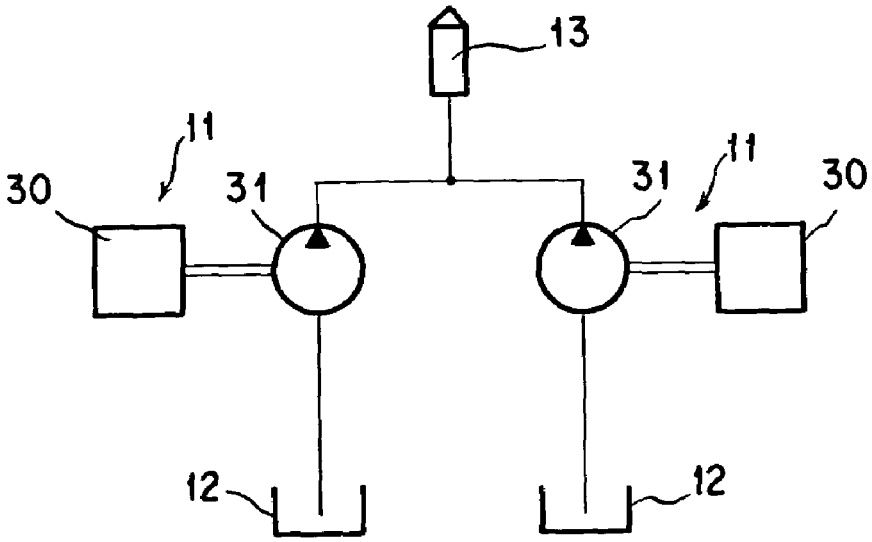

Furthermore, there may be also adopted a structure in which the liquid soil conditioners of the different kinds are mixed and then ejected through one liquid ejecting means 13. In this case, as shown in FIG. 13A, the liquid soil conditioners stocked in the plurality of the liquid tanks 12 are sucked and discharged by one fluid pump 31. In another case shown in FIG. 13B, the liquid soil conditioners stocked in the plurality of the liquid tanks 12 are respectively sucked by the different fluid pumps 31, and the discharge sides of these fluid pumps 31 are combined together to thereby supply the liquid soil conditioners to one liquid ejecting means 13 under pressure.

The rear mixer 42 may be disposed independently from the modified soil conveying device 10. In this case, for example, the cover member 41 is mounted to a support frame disposed on the ground or a movable support frame through the mount member 40, or the cover member 41 is directly mounted to the support frame.

Further, the liquid ejecting means 13 and the rear mixer 42 may be mounted to an intermediate portion on the way of the conveying direction of the modified soil conveying device 10.

Further, it may be possible to supply only the liquid soil conditioner to thereby improve the soil condition while stopping the operation of the solid soil conditioner supply device 9, and otherwise, only the solid soil conditioner supply device 9 may be driven.

Next, a concrete example of the soil modification will be explained hereunder.

A polymer-type solidifying agent in state of liquid is ejected from the liquid ejecting means 13 attached to a portion near the inlet port of the mixer 3 as shown in FIG. 4 or a portion near the mixer than the raking rotor 21 in the raw soil hopper 8 as shown in FIG. 7.

A mud as the raw soil is thrown in the raw soil hopper 8, and then, the mud and the polymer-type solidifying agent are mixed by the mixer 3 to thereby modify the nature and condition of the mixture to form a modified soil, which is then conveyed by the modified soil conveying device 10 outside the machine body.

According the operation mentioned above, the mud, for example, discharged at a time of the tunnel excavation using a shield-type tunnel excavator, can be modified to a hard soil having a good quality.

Further, it is preferable that a ferrous sulfate solvent is ejected from the liquid ejecting means 13 (shown in FIG. 6A) attached to a portion near the input port of the mixer 3 shown in FIG. 4 while water is ejected from the liquid ejecting means 13 (shown in FIG. 6B or 6C) attached to the modified soil conveying device 10 shown in FIG. 7C, and a soil polluted with hexavalent chromium is thrown in the raw soil hopper 8 as the raw soil.

According to this arrangement, the soil polluted with hexavalent chromium and the ferrous sulfate solvent are mixed by the mixer 3, and the water is then ejected to the mixture. Therefore, the soil polluted with hexavalent chromium can be modified to obtain a state of the hexavalent chromium being undissolved. In addition, due to the addition of the water, the reaction of modifying the quality of the soil can be easily promoted.

Furthermore, it is also preferable that a ferrous sulfate solvent is ejected from the liquid ejecting means 13 (shown in FIG. 6B) attached to the mixer 3 shown in FIG. 7B while water being ejected from the liquid ejecting means 13 (shown in FIG. 6B or 6C) attached for the modified soil conveying device 10 shown in FIG. 7C, and the soil polluted with hexavalent chromium is thrown in the raw soil hopper 8 as a raw soil.

According to such arrangement, the soil polluted with hexavalent chromium and the ferrous sulfate solvent are mixed by the mixer 3, and the water is then ejected to the mixture. Therefore, the soil polluted with hexavalent chromium can be modified to obtain a state of the hexavalent chromium being undissolved. In addition, due to the addition of the water, the reaction of modifying the quality of the soil can be easily promoted.

It is also possible to modify the self-propelled soil modifying machine into a soil modifying machine provided with no modified soil conveying device 10 mentioned hereinbefore. In this case, the power source unit 4 supplies the power to the traveling equipments 2, the raw soil conveying device 7 and the mixer 3.

In this case, since the modified soil is discharged through the discharge port 24 of the mixer 3, it is also possible to adopt an arrangement in which a belt conveyer for discharging the modified soil is independently mounted below the discharge port 24 to thereby discharge the modified soil outside the machine body or the discharge port 24 of the mixer 3 is formed to a portion outside the machine body (i.e., a portion forwardly apart from the traveling equipment 2) to thereby discharge the modified soil outside the machine body.

In case of using the self-propelled soil modifying machine mentioned above, it is also possible to mount the liquid ejecting means 13 and the rear mixer 42 to a portion close to the discharge port 24 of the mixer 3.

Figure 14:
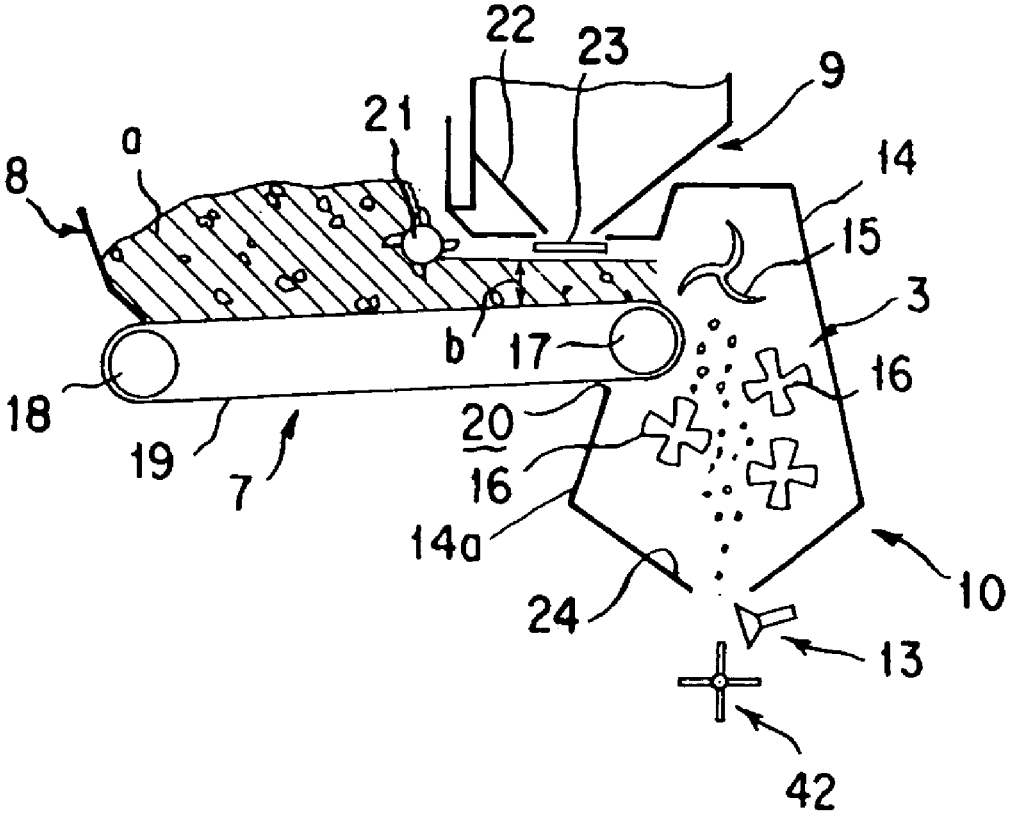
FIG. 14 is an explanatory view showing an example in 4 which the liquid ejecting means and the rear mixer are mounted to a portion close to a discharge port of the mixer.

For example, as shown in FIG. 14, the discharge port 24 of the mixer 3 is formed so as to provide a shape having a narrow width, and the liquid ejecting means 13 and the rear mixer 42 are mounted to a portion close to the discharge port 24 of the case 14 through the mount member 40 and the cover member 41 as the same manner as that described hereinbefore.

According to this arrangement, a crushed soil having a fine powdery state including no lump soil discharged from the discharge port 24 of the mixer 3 can be effectively mixed with the liquid soil conditioner, and thereafter, the mixture can be further sufficiently mixed by the rear mixer 42.

Next, the control system for controlling a supply amount of the liquid soil conditioner will be explained hereunder.

In the arrangement mentioned above, a raw soil supplying speed is controlled by adjusting the motor for driving the driving wheel 17 of the raw soil conveying device 7 and the motor for rotating the rotor 21 mounted in the raw soil hopper 8.

Further, the amount of the liquid soil conditioner to be ejected from the liquid ejecting means 13 is controlled by adjusting a revolution speed of the fluid pump 31 driven by the power source 30 for the pump.

Furthermore, a detecting means for detecting a raw soil supply amount is provided to a portion close to the input port 20 of the mixer 3. For example, a plurality of switches or laser systems as the detecting means detect a height of the raw soil to be supplied, and the amount of the raw soil to be supplied per unit time is detected in accordance with the height of the raw soil to be supplied and the raw soil supplying speed (conveying speed) at the raw soil conveying device.

In the arrangement mentioned hereinbefore, a mixing ratio of the raw soil and the liquid soil conditioner is previously set to an appropriate value. Based on this mixing ratio and the detected amount of the raw soil, the raw soil supply speed or the amount of the liquid soil conditioner is controlled to thereby secure a constant mixing ratio at any time.

In the described embodiment, although both the liquid supply means 11 and the liquid tank 12 are mounted to the machine body 1, it is also possible to independently or separately dispose at least one of the liquid supply means 11 and the liquid tank 12 from the machine body 1.

Figure 15A:
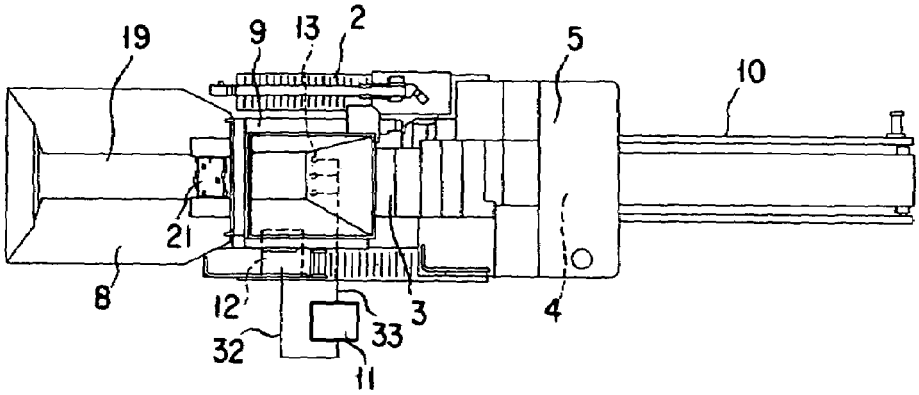
FIGS. 15A to 15C are explanatory views each explaining a mounting position of a liquid supply means and a liquid tank.

For example, as shown in FIG. 15A, the liquid supply means 11 is independently disposed from the machine body 1, and the suction port of the liquid supply means 11 is connected to the liquid tank 12 mounted to the machine body 1 through the suction pipe 32 while the delivery pipe 33 is connected to the liquid ejecting means 13.

Figure 15B:
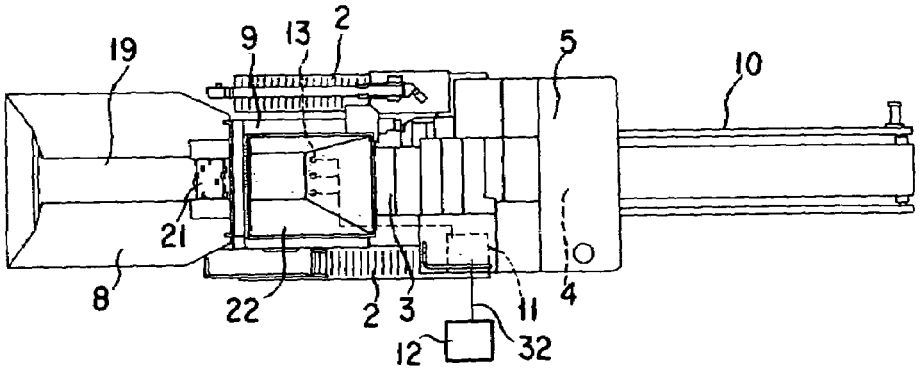

Further, as shown in FIG. 15B, the liquid tank 12 is independently disposed from the machine body 1, and the suction port of the liquid supply means 11 mounted to the machine body is connected to the liquid tank 12 through the suction pipe 32.

Figure 15C:
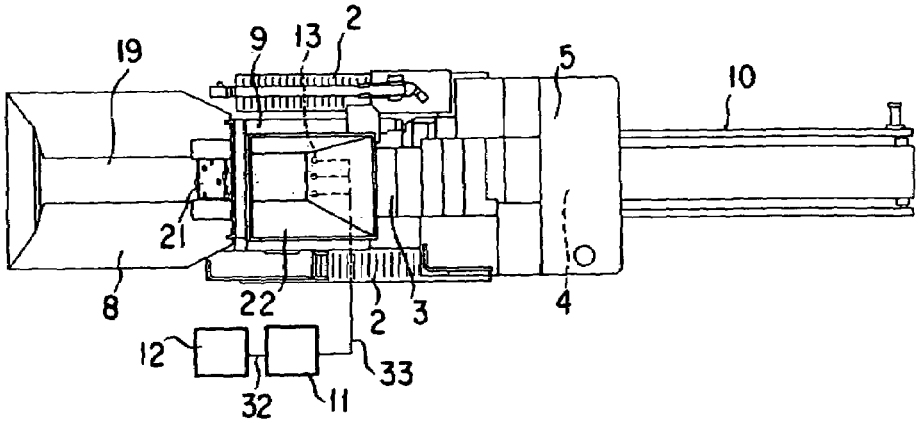

Furthermore, as shown in FIG. 15C, both the liquid supply means 11 and the liquid tank 12 are independently disposed from 4 the machine body 1, and the delivery pipe 33 is connected to the liquid ejecting means 13.

Although the present invention has been described with reference to the exemplified embodiments, it will be apparent to those skilled in the art that various modifications, changes, omissions, additions and other variations can be made in the disclosed embodiments of the present invention without departing from the scope or spirit of the present invention. Accordingly, it should be understood that the present invention is not limited to the described embodiments and shall include the scope specified by the elements defined in the appended claims and range of equivalency of the claims.

What is claimed is:

1. A self-propelled soil modifying machine comprising:

a machine body (1) provided with traveling equipment (2);

a soil hopper (8) mounted to the machine body (1), into which an excavated soil or a polluted soil to be modified is thrown;

a soil conveying device (7) mounted to the machine body (1) for conveying the soil charged into the soil hopper (8);

a solid soil conditioner supply device (9) mounted to said machine body (1) and adapted to supply a solid soil conditioner to the soil conveyed by the soil conveying device (7);

a mixer (3) mounted to the machine body (1) for mixing the soil conveyed through the soil conveying device (7);

a power source unit (4) mounted to the machine body (1) for supplying power to said traveling equipment (2), the soil conveying device (7) and the mixer (3); and a liquid soil conditioner supply device including a liquid ejecting means (13), a liquid supply means (11) and a liquid tank (12) connected in series, for ejecting a liquid soil conditioner from the liquid ejecting means (13) to which the liquid soil conditioner stocked in the liquid tank (12) is supplied by the liquid supply means (11), further comprising a rear mixer (42) for mixing soil discharged from the mixer (3), wherein said liquid ejecting means (13) is attached to at least one portion in a passage ranging from the soil hopper (8) to a discharge portion of the mixer (3).

2. A self-propelled soil modifying machine according to claim 1, wherein said liquid ejecting means (13) is attached to the discharge portion of the mixer (3), and the rear mixer (42) for mixing the ejected liquid soil conditioner with the discharged soil is mounted to a portion lower than said liquid ejecting means (13).

3. A self-propelled soil modifying machine according to claim 1, wherein said liquid supply means (11) and the liquid tank (12) are mounted to the machine body (1).

4. A self-propelled soil modifying machine according to claim 1, wherein either said liquid supply means (11) or the liquid tank (12) is independently disposed from the machine body (1).

5. A self-propelled soil modifying machine according to claim 1, wherein both the liquid supply means (11) and liquid tank (12) are independently disposed from the machine body (1).

6. A self-propelled soil modifying machine;

a machine body (1) provided with traveling equipment (2);

a soil hopper (8) mounted to the machine body (1), into which an excavated soil or a polluted soil to be modified is thrown;

a soil conveying device (7) mounted to the machine body (1) for conveying the soil charged into the soil hopper (8);

a solid soil conditioner supply device (9) mounted to said machine body (1) and adapted to supply a solid soil conditioner to the soil conveyed by the soil conveying device (7);

a mixer (3) mounted to the machine body (1) for mixing the soil conveyed through the soil conveying device (7);

a power source unit (4) mounted to the machine body (1) for supplying power to said traveling equipment (2), the soil conveying device (7) and the mixer (3); and a liquid soil conditioner supply device including a liquid ejecting means (13), a liquid supply means (11) and a liquid tank (12) connected in series, for ejecting a liquid soil conditioner from the liquid ejecting means (13) to which the liquid soil conditioner stocked in the liquid tank (12) is supplied by the liquid supply means (11), wherein said liquid ejecting means (13) is attached to a portion above the soil conveying device (7) in the vicinity of an input port of the mixer (3).

7. A self-propelled soil modifying machine comprising:

a machine body (1) provided with traveling equipment (2);

a soil hopper (8) mounted to the machine body (1), into which an excavated soil or a polluted soil to be modified is thrown;

a soil conveying device (7) mounted to the machine body (1) for conveying the soil charged in the soil hopper (8);

a solid soil conditioner supply device (9) mounted to the machine body (1) and adapted to supply a solid soil conditioner to the soil conveyed through the soil conveying device (7);

a mixer (3) mounted to the machine body (1) for mixing the soil conveyed by the soil conveying device (7);

a modified soil conveying device (10) mounted to the machine body (1) for discharging the soil mixed by said mixer (3);

a power source unit (4) mounted to the machine body (1) for supplying power to said traveling equipment (1), the soil conveying device (7), the mixer (3) and the modified soil conveying device (10); and a liquid soil conditioner supply device including a liquid ejecting means (13), a liquid supply means (11) and a liquid tank (12) connected in series, for ejecting a liquid soil conditioner from the liquid ejecting means (13) to which the liquid soil conditioner stocked in the liquid tank (12) is supplied by the liquid supply means (11), further comprising a rear mixer (42) for mixing soil discharged from the modified soil conveying device (10), wherein said liquid ejecting means (13) is attached to at least one portion in a passage ranging from the soil hopper (8) to the modified soil conveying device (10).

8. A self-propelled soil modifying machine according to claim 7, wherein said liquid ejecting means (13) is attached to a discharge portion of the modified soil conveying device (10), and the rear mixer (42) for mixing the ejected liquid soil conditioner with the discharged soil is mounted to a portion lower than said liquid ejecting means (13).

* * * * *

UNITED STATES PATENT AND TRADEMARK OFFICE

CERTIFICATE OF CORRECTION

PATENT NO. : 6,874,973 B1
DATED : April 5, 2005
INVENTOR(S) : Yasuhiro Yoshida

It is certified that error appears in the above-identified patent and that said Letters Patent is hereby corrected as shown below:

Title page,
Item [57], ABSTRACT,
Lines 5, 6, 12, 14 and 15, "means" should read -- member --.

Signed and Sealed this

Thirty-first Day of May, 2005

JON W. DUDAS
*Director of the United States Patent and Trademark Office*